US009467792B2

(12) United States Patent
Morrow

(10) Patent No.: US 9,467,792 B2
(45) Date of Patent: Oct. 11, 2016

(54) METHOD FOR PROCESSING OF SOUND SIGNALS

(71) Applicant: Charles Morrow, Barton, VT (US)

(72) Inventor: Charles Morrow, Barton, VT (US)

(73) Assignee: MORROW LABS LLC, Barton, VT (US)

( * ) Notice: Subject to any disclaimer, the term of this patent is extended or adjusted under 35 U.S.C. 154(b) by 420 days.

(21) Appl. No.: 13/946,312

(22) Filed: Jul. 19, 2013

(65) Prior Publication Data

US 2015/0023505 A1 Jan. 22, 2015

(51) Int. Cl.

| | |
|---|---|
| ***H04S 5/00*** | (2006.01) |
| ***H04R 3/12*** | (2006.01) |
| ***H04R 5/02*** | (2006.01) |
| ***H04S 7/00*** | (2006.01) |

(52) U.S. Cl.

CPC . *H04S 5/00* (2013.01); *H04R 3/12* (2013.01); *H04R 5/02* (2013.01); *H04S 7/30* (2013.01); *H04S 7/305* (2013.01)

(58) Field of Classification Search

CPC ..... H04R 3/12; H04R 5/02; H04S 5/00; H04S 7/305; H04S 7/30

USPC ..... 381/1, 17–21, 303, 27, 77, 79, 80, 300, 381/307, 61, 63, 66

See application file for complete search history.

(56) References Cited

U.S. PATENT DOCUMENTS

2003/0007648 A1 1/2003 Currell

FOREIGN PATENT DOCUMENTS

EP 1850638 A2 10/2007

OTHER PUBLICATIONS

ITU-R, "Multichannel sound technology in home and broadcasting application—Report ITU-R BS.2159-4", May 2012.*

* cited by examiner

*Primary Examiner* — David Ton
(74) *Attorney, Agent, or Firm* — Young & Thompson

(57) ABSTRACT

A method for processing audio signals for creating a three dimensional sound environment includes: receiving at least one input signal from at least one sound source; creating a simulated signal at least in part on the basis of the received at least one input signal, the simulated signal representing a simulation of at least one input signal reflecting from the ground or floor; and creating an output signal at least partly on the basis of the simulated signal and the at least one received input signal, the output signal including a plurality of audio channels; at least two channels of the audio channels of the output signal representing signals for sound transducers above a listener's ear level at a nominal listening position, and at least two channels of the audio channels of the output signal representing signals for sound transducers below a listeners ear level at a nominal listening position.

33 Claims, 3 Drawing Sheets

METHOD FOR PROCESSING OF SOUND SIGNALS

FIELD OF INVENTION

The current invention is related to processing of sound. In particular, the current invention is concerned with processing of sound for creating a 3D sound environment.

DESCRIPTION OF PRIOR ART

Some approaches for creating 3D sound environments are known. Existing solutions typically require the use of complicated mathematical functions such as Head Related Transfer Functions (HRTF), and other types of complicated signal processing functions. Other approaches include an approach known as ambisonics, which aims to reproduce the complete soundfield at the listener location, requiring also complicated signal processing and complicated loudspeaker setups.

An advantageous embodiment of the invention is described in the following in a general level with reference to FIGS. 1, 2, and 3.

Figure 1:
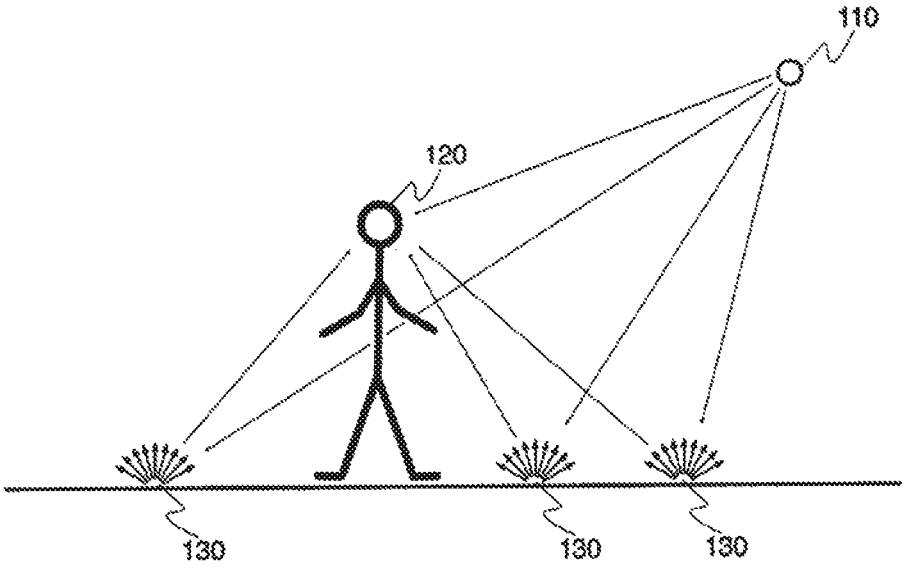
FIG. 1 illustrates various reflections of a sound.

FIG. 1 illustrates a situation where a sound source 110 creates a sound wave, which then propagates towards the listener 120. The sound waves also reflect from all obstacles they meet, even from the ground, producing ground reflections 130. The inventor has found out that creating a three dimensional sound environment that sounds realistic and immersive for the listener, requires taking ground reflections into account.

Sound travels and propagates as a spherical wavefront from the location of the sound, and reflects from everything it meets. How the reflection happens, how the reflection affects the frequencies of the reflected sound and to which directions the reflections go depend on the shape and materials of the objects at the point of reflection. So, the listener is surrounded by not only the sound arriving directly from the sound source, but also from the reflections from all over the environment. The inventor has found that simulating ground reflections is required for a good quality, immersive 3D sound environment, if ground reflections are not already included in e.g. a recorded sound signal.

It is further advantageous for the strength of the created 3D illusion, if the ground reflections are provided from more than one direction and not only from the direction of the sound source, whose sound is being reflected.

The simulated ground reflections are advantageously provided at a suitable volume level to match the expectations of a listener's brain. These parameters are discussed further later in this specification.

Several scientific studies have shown that the directional resolution of sound perception in humans is most accurate in the horizontal plane, and much less accurate in determining the vertical direction of a sound. However, the inventor has found that a major component of perception of sound direction along the vertical, i.e. the apparent height of a sound source, is reflection of that sound from the ground. In order to create an immersive experience in an artificial soundscape of sound coming from many directions and heights, a simulation of ground reflections needs to be included in the reproduced sound.

The inventor has also found that the creation of an immersive 3D sound experience requires the use of multiple loudspeakers in reproduction of the sound. In order to create a good quality 3D sound experience, at least two loudspeakers are needed below the listener's ear level, and at least two above the listener's ear level. In the context of this specification, terms above and below are intended to mean the position of a loudspeaker from the point of view of a listener.

Such a loudspeaker arrangement allows the reproduction of ground reflections so that they arrive to the listener's ear from a downward direction, i.e. from below the ear level of the listener.

Figure 2:
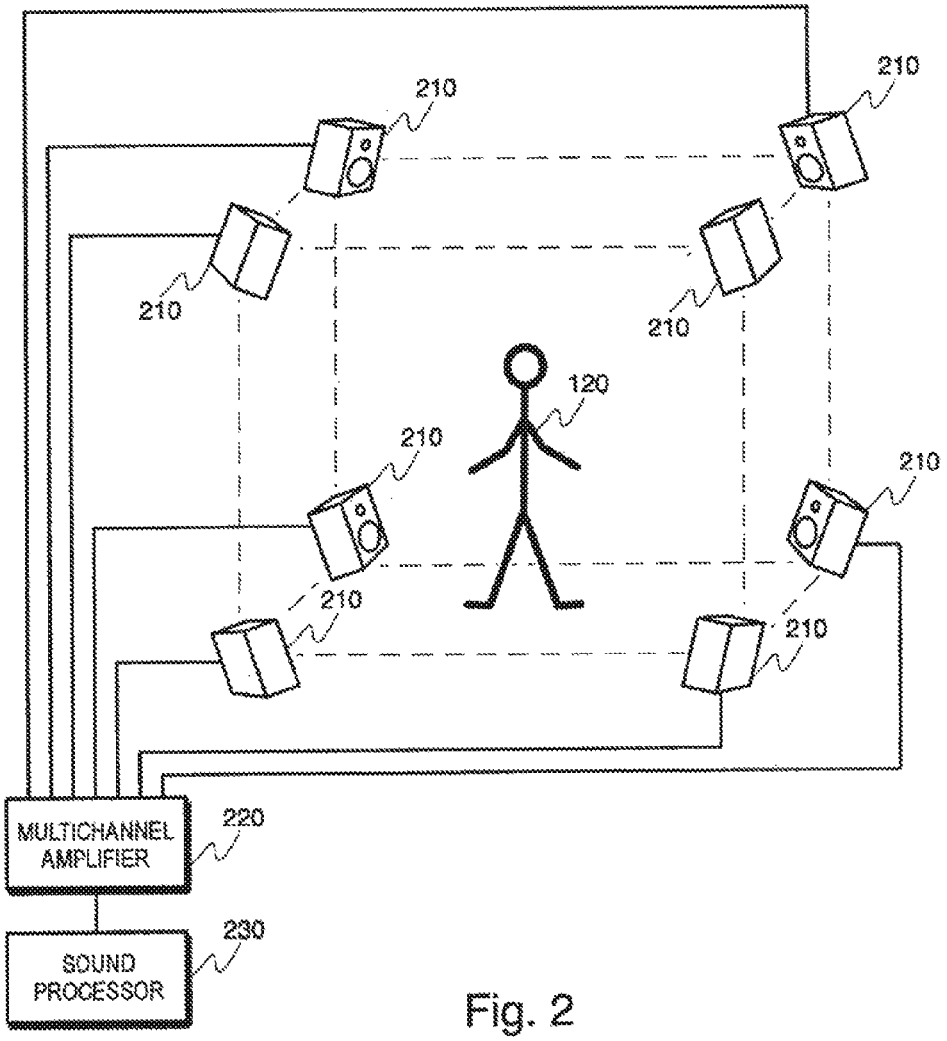
FIG. 2 illustrates a sound processing and reproduction system according to an advantageous embodiment of the invention.
Figure 3:
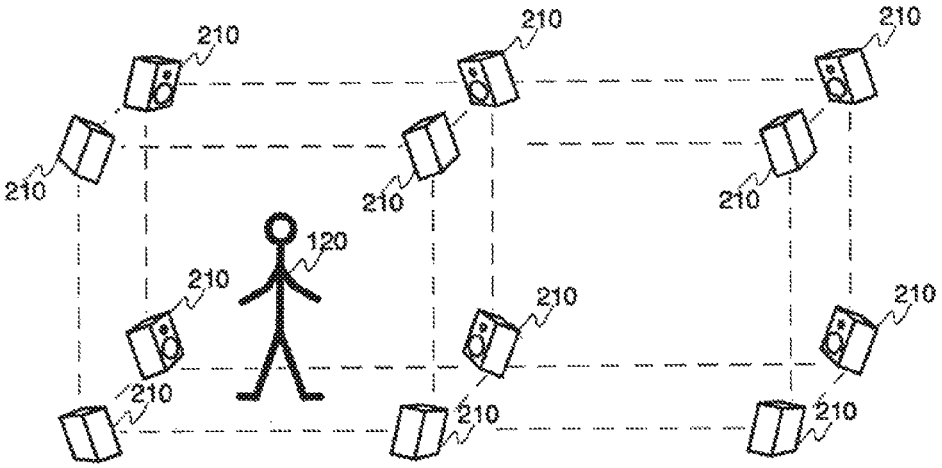
FIG. 3 illustrates the provision of more than one consecutive cubical arrangement of loudspeakers.

An advantageous arrangement for loudspeakers is to arrange the loudspeakers in a roughly cubic form around the listener, as illustrated in FIG. 2. FIG. 2 illustrates a system according to an advantageous embodiment of the invention. FIG. 2 illustrates a plurality of loudspeakers 210, and the listener 120 inside the cube formed by the loudspeakers 210.

The loudspeakers are connected to a multichannel amplifier 220, which is connected to a sound processor 230. In this exemplary embodiment the sound processor has inputs for receiving sound signals.

The inventor has further found that 3D illusion of point sources in a 3D space can be greatly enhanced by creating a background 3D soundscape using simulated ground reflections. When an illusion of a 3D world around the listener has already been created using 3D background sound, the three dimensionality of added point sources in the 3D space is greatly enhanced in the mind of the listener. The resulting 3D illusion is remarkably stronger than without a 3D background. The 3D background appears to prime the listener's perception towards a 3D world, in which the added point sources are located.

In the following, we describe a sound processing unit according to an advantageous embodiment of the invention.

Inputs to this sound processing unit can vary according to specific implementations of various embodiments of the invention. The input can be for example a conventional stereo signal, which is then processed to a simulated 3D sound signal. This processing is described in more detail later in this specification.

The inputs can also be one or more discrete sound sources with or without associated location information. For example, in such an embodiment where the sound processing is performed for use in an electronic computer game setting, the inputs can be sounds from various components, various objects in the game scene currently being played and their associated location information.

There also can be sound signals which are not associated with a specific location. Such sound signals can be used for example in the creation of the background sound environment. For example, a number of nature sounds can be combined and placed in 3D virtual world, simulating their reflections, in order to create an illusion of nearby natural objects. For example, the natural objects could be trees, and the sound could be the wind blowing in a tree and a number of them is combined to provide an illusion of a patch of forest making sound due to the wind.

In an advantageous embodiment of the invention small movements are added to the location of at least one sound source. This is advantageous because static sound sources tend to recede from the listeners perception. But if they are perceived to move, even slightly, that tends to keep the sound sources more strongly perceived by the listener.

The output signal of a sound processing unit according to the present embodiment of the invention is a multichannel sound signal.

The sound signal can be structured in different ways in various implementations of various embodiments of the invention. For example, the signal can comprise a number of analog signals, which are ready for amplifying and reproduction through loudspeakers. The output signal can also be in a digital format.

There are many different digital formats for audio signals as a man skilled in the art knows. Therefore any details of such digital audio formats are not discussed any further in this specification for reasons of clarity.

The output signal can comprise at least two channels for loudspeakers above the listener's ear level and at least two for loudspeakers below the listener's ear level. The output signal can also comprise more signal channels for more loudspeakers, for example eight channels for eight loudspeakers for a cube format arrangement. The output signal can also comprise at least one output channel for a subwoofer loudspeaker for enhanced reproduction of low frequency sounds. In different embodiments of the invention the output signal can be treated in different ways. For example, the output signal with all its channels, can be saved on a storage medium for playback later. For example, if the output signal is a soundtrack of a movie for reproduction in a movie theater equipped with a suitable loudspeaker system such as that shown in FIG. 2.

The output signal can also be saved in different formats. For example, if the output signal is an analog audio signal, it can be stored in any of the known ways of storing analog audio. And the same goes for digital signals.

The output signal can also comprise more than eight channels. For example, if the signal is intended to be replayed through a loudspeaker arrangement comprising two loudspeaker cubes, then that output signal would need 12 channels for 12 loudspeakers. Or, if the output signal is intended to be replayed through an even larger loudspeaker arrangement in a larger space, then the output signal can correspondingly comprise even more channels.

The processing of sound can be implemented in many different ways and in many different locations in various embodiments of the invention. For example, simulation of the ground reflections can be implemented using software on a conventional computer or for example using software in a specific audio signal processing unit. Simulations of the ground reflections can also be implemented as a hardware based solution using digital signal processing circuitry.

The simulations of ground reflections can also be implemented as a part of a larger software system such as a computer game or it can be implemented for example as a software entity separate from that of the game, only processing signals produced by the game software. So the invention can be implemented as a part of a larger system, either a software based system, a hardware based system or a combination of these, or as a separate functional device or as a separate software modules.

In a further advantageous embodiment of the invention, frequency selective processing is used in creation of simulations of ground reflections. For example, in an advantageous embodiment of the invention, lower frequencies of a sound are enhanced in creation of a ground reflection. For example, in an embodiment where a ground reflection of a sound coming from upper right direction of the listener is simulated by mixing a part of the sound signal to an output signal channel for a bottom left loudspeaker, said part is processed so that the lower end of the spectrum of the sound is enhanced.

In a further advantageous embodiment of the invention, the strength of enhancement of lower frequencies inversely depends on the simulated height of the sound source. That is, if the sound source is in the simulation simulated to be very close to the ground, the low frequencies of the simulated reflections are enhanced more strongly related to the higher frequencies of the simulated reflection than in the case of the sound source being simulated to be situated above the listener, for example.

In the following we describe the placement of loudspeakers according to some embodiments of the invention. In order to be able to reproduce ground reflections at least two loudspeakers need to be below the ear level of a listener, and at least two loudspeakers above the ear level of the listener. In an advantageous embodiment of the invention the loudspeakers are arranged in a roughly square or rectangular formation. The inventor has found that even such a simple arrangement can produce a fairly realistic simulation of sounds coming from the general direction of the loudspeaker arrangement. For example, when the loudspeaker arrangement is situated in front of a listener, such a loudspeaker system can reproduce simulations that appear to come from behind the loudspeaker arrangement, from behind the plane of the loudspeaker arrangement.

In a further advantageous embodiment of the invention the loudspeakers are arranged in a roughly cubic form around the listener. Such a loudspeaker arrangement can reproduce a 3D simulation in all directions from the listener. The cubic form or a roughly cubic form is an economical approximation of a theoretically perfect system. Adding more loudspeakers around the listener would increase the quality of the 3D sound illusion, however, the cubical structure is practically sufficient for a very convincing 3D simulation.

The cubical format is forgiving regarding imperfections in placement. It is not very sensitive to deviations from a perfect cubical setup. Therefore the loudspeakers can be arranged depending on the practical demands of the listening area, for example depending on the possibilities where a loudspeaker can be set up in a room. There are some practical limits to the size of a cube of loudspeakers. Around 3 to 5 meters per side of the cube produces very good simulations, and the cube size up to roughly 8 to 10 meters per side still can produce a good simulation. But if the size of the cube is increased beyond roughly 10 meters, the quality of the simulation begins to suffer.

In case of a need to cover a larger listening area, like a seating area of a large movie theater, it is advantageous to set up more than one cube beside each other. FIG. 3 illustrates a setup in which two cubes are formed using 12 loudspeakers 210.

It may also be advantageous to use more than one cube in order to produce a more accurate simulation of sound in certain directions. For example if the simulation needs to reproduce sounds originating at different levels above the listeners, it is advantageous to set up two cubes on top of each other. In that way the loudspeaker system can more convincingly reproduce a simulation of a sound source being situated far above the heads of the listeners and then coming down from there. Also a case where more than one cube is needed in order to produce a good simulation is the case where the listening space is long, such as a corridor. Such a listening space can be covered with a number of consecutive cubes.

In a further advantageous embodiment of the invention there are more loudspeakers below the listener's ear level than above. For example if the 3D simulation is needed to be performed in a room where it is not possible or feasible to place loudspeakers in the middle of the ceiling, it is nevertheless good for reproducing a convincing simulation to place one or more extra loudspeakers at the floor level in the same place in the room in order to enhance reproduction of ground reflections, which are important in order to create a convincing 3D simulation.

In a further advantageous embodiment of the invention one or more extra loudspeakers are used to reproduce low frequency sound. For example, a conventional subwoofer loudspeaker can be used to enhance the reproduction of low frequency sounds.

In a further advantageous embodiment of the invention prerecorded sound is used as at least a part of a 3D sound environment.

Sound of a location of an environment can be recorded so that the ground reflections are recorded at the same time. That can be performed using the microphones in a vertical configuration, that is, one microphone close to the ground and one further up. Naturally to get a left to right distinction, one can use more than these two microphones. Such a recording does already include at least some ground reflections and so is very good for use as a background sound of a 3D sound environment.

Because such a recording already includes ground reflections of sounds occurring in the recording, there is no need to add further simulated ground reflections corresponding to sounds in the recording.

Such a recording can be used to form the illusion of a 3D space on top of which then further sound sources can be added so that the reproduction of these added sound sources benefits from the illusion already created by the reproduction of the recording.

In a further advantageous embodiment of the invention, the sound processing unit comprises a storage means or is connected to a storage means having a plurality of pieces of prerecorded sound, which can then be used in simulations. These sounds can then be selected to be part of the simulation for example, by the entity feeding sound signals to the sound processing unit. For example in a game implementation, the game engine can signal the sound processing unit to replay a prerecorded sound corresponding to the current play scene for creating background sound for any other sounds associated with objects in that scene.

In an advantageous embodiment of the invention, ground reflections are simulated by adding a part of an audio signal intended for a first output signal channel representing a first loudspeaker into an audio signal intended for a second output signal channel representing a second loudspeaker diagonally opposite to the first loudspeaker in the arrangement of loudspeakers the first and second loudspeakers are a part of. For example, a part of a signal intended for a loudspeaker at a upper right position with respect to a nominal position of a listener, is added to a signal intended for a loudspeaker at a lower left position with respect to a nominal position of a listener, and a signal intended for a loudspeaker at a upper left position is mixed to a signal for a loudspeaker at a lower right position. The inventor has realized that this technically simple method of diagonal mixing is good enough to give an illusion of sound reflections from ground or a floor and to give rise to a perception of three-dimensional sound, even though this simple method is not a theoretically accurate way of simulating ground reflections.

The ratio in which a signal is added to an upper channel relative to a diagonally opposite lower channel affects the perceived height of the signal source. When a signal source is desired to be perceived to be at a low height where the ground reflections are relatively strong, the signal should be added to a lower output channel in larger amplitude than to a higher output channel. Conversely, when a signal source is desired to be perceived to be high above the ground, the signal should be added to a higher output channel at a higher amplitude than to a lower output channel.

In a further advantageous embodiment of the invention, an illusion of a 3D soundscape is created from a stereo audio signal by adding simulations of ground reflections. These simulations can be created for example by using the previously described diagonal mixing principle. For example, in case the output signal has two channels for upper loudspeakers (sound transducers) and two channels for lower loudspeakers, the left stereo channel signal is added to an output channel for the upper left loudspeaker at a first amplitude and to an output channel for the lower right loudspeaker at a second amplitude; and the right stereo channel signal is added to an output channel for the upper right loudspeaker at the first amplitude and to an output channel for the lower left loudspeaker at the second amplitude. When the ratio of the first amplitude to the second amplitude is adjusted to a suitable value, an illusion of a 3D sound environment is perceived by a listener. The inventor has found that the range where the 3D illusion is perceived is rather narrow. Outside that range, the listener simply perceives the sound from coming from the different loudspeakers. Within that range, an illusion of the sound forming a 3D environment forms. Advantageously, the ratio of the first amplitude to the second amplitude is within the range of 49:51 to 30:70.

In a further advantageous embodiment of the invention, the ratio of the first amplitude to the second amplitude is within the range of 42:58 to 32:68.

In a still further advantageous embodiment of the invention, the ratio of the first amplitude to the second amplitude is within the range of 40:60 to 37:63.

In a further advantageous embodiment of the invention, a part of the left stereo channel signal is added to an output channel for the lower left loudspeaker as well, and a part of the right stereo channel signal is added to an output channel for the lower right loudspeaker as well.

In an advantageous embodiment in which the output signal comprises channels for eight loudspeakers in a cubic arrangement, the left stereo channel signal is added to the front and back upper left loudspeaker channels at a first amplitude and the front and back lower right loudspeaker channels at a second amplitude. The right stereo channel signal is added to the front and back upper right loudspeaker channels at the first amplitude and the front and back lower left loudspeaker channels at the second amplitude. Suitable values for the ratios of the first and second amplitudes are those described previously with an example of a four output loudspeaker channel setup.

At the time of writing of this patent application, the so-called 5.1 surround signal format is rather common in television and home theater sets. A 5.1 surround signal system generally has five main loudspeakers, namely one front left loudspeaker, one front right, one back left and one back right loudspeaker, and one front center loudspeaker. In addition to these, a typical 5.1 system also has a subwoofer loudspeaker, hence the 0.1 in the name. A 5.1 surround system is supposed to reproduce sounds around the listener. A 5.1 surround system cannot reproduce a 3D sound environment. However, in a further advantageous embodiment of the invention, a 5.1 surround signal is processed for creation of a simulated 3D sound environment by adding simulated ground reflections. In this embodiment, the creation of an output signal with channels for loudspeakers in a cubic arrangement proceeds as follows. The front right 5.1 input signal is added to the upper front right output channel at a first amplitude, and to the lower front left output channel at a second amplitude. The front left 5.1 input signal is added to the upper front left output channel at a first amplitude, and to the lower front right output channel at a second amplitude. The back right 5.1 input signal is added to the upper back right output channel at a first amplitude, and to the lower back left output channel at a second amplitude. The back left 5.1 input signal is added to the upper back left output channel at a first amplitude, and to the lower back right output channel at a second amplitude. Suitable values for the ratios of the first and second amplitudes are those described previously with an example of a four output loudspeaker channel setup.

In a further advantageous embodiment of the invention, the 5.1 front center input signal is added to the upper front left and upper front right output channels at a third amplitude, and to the lower front left and lower front right output channels at a fourth amplitude. In this arrangement, a front center loudspeaker is not needed, since the front center channel signal is reproduced by all four front loudspeakers, giving rise to a perceived virtual front center loudspeaker. The third and fourth amplitudes can be adjusted to place the perceived height of the virtual front center loudspeaker at a suitable level. The third and fourth amplitudes can, for example, be the same. This arrangement has the further advantage that a physical front center loudspeaker is not needed. A physical loudspeaker can be cumbersome to arrange for example in a setup, where there is a viewing screen in front of the listeners. Typical solutions include locating the front center loudspeaker behind the screen, or below the screen, both of which solutions may be suboptimal. Using two upper and two lower front loudspeakers avoids the need for an actual physical front center loudspeaker.

The inventive sound processing method can be used in many different applications and implementations for producing 3D sound environments for various purposes. Some examples are described in the following.

For example, in an advantageous embodiment of the invention, a system for providing a 3D background for a space is provided. A subtle 3D background sound environment can be used for altering the mood or atmosphere in a room, for example. Such a system creates an output signal for a plurality of loudspeakers.

Preferably, such a system is connectable to a data communication network such as the Internet for connecting to a signal source. Such a system can advantageously also comprise an audio input, for example for a stereo or a 5.1 surround sound input, on the basis of which the system can then produce a simulated 3D sound environment for example as described previously in this specification. For example, such a system is advantageously arranged to receive a background audio signal for reproduction of a 3D audio signal, on top of which a sound signal such as music received via said audio input is added. Such a system can advantageously be used for creating a background audio environment for shops and other businesses.

In a further advantageous embodiment of the invention, a system for providing a common background audio environment in two or more disparate locations is provided. Such a system comprises a device or a subsystem at each of the disparate locations for creation and reproduction of a 3D background sound environment in any of the ways described in this specification. Preferably, these devices or subsystems are arranged to communicate between each other in order to synchronize the background sound environments in the disparate locations. Such a system can provide a shared 3D background environment for all of the locations for a telephone or a video conference, creating a sense of being in the same audio space, and increasing the quality of the conference experience of the participants.

In a further advantageous embodiment of the invention, a 3D sound system for a movie theater is provided. In such an embodiment, the sound system preferably comprises a sound processor for creating a simulated 3D audio environment on the basis of a stereo or a surround audio signal in any of the ways described in this specification. Preferably, the 3D sound system is further arranged to reproduce individual 3D audio signals of the movie on top of a simulated 3D audio environment.

The invention has numerous advantages. The inventive method provides for modular, additive, layering, scalable and networkable processing of sounds for 3D audio environments. The described additive way of simulating ground reflections for producing a 3D illusion allows combining of multiple 3D sounds over each other seamlessly, without causing any audible undesired artifacts in the output. This allows for creation of 3D sound environments with many parts, which can be programmatically controlled and combined from different sources. For example, combining of sounds allows creation of a subtly changing background based on a number of sound sources such as recordings, on top of which individual sound items, such as moving birds or vehicles, can be added.

The described additive way of simulating ground reflections for producing a 3D illusion does not introduce audible latency, whereby this method can be used also in live shows. Creation of a 3D sound environment can be used to enhance the experience of the viewers of a live show. For example, a 3D sound environment can be used to enlarge the space a performing band is perceived to be in. A 3D sound environment can also be used for monitoring purposes for the band or orchestra itself. The inventor has found that a 3D sound environment is very advantageous for monitoring purposes, as the 3D nature of the sound environment allows listeners—in this case the band players themselves—to discern different sound sources—in this case instruments—from the others on the basis of direction and perceived location. A traditional monitoring setup provides one or more loudspeakers in front of the players, and the practically only way to have the monitoring signal heard by the players well enough is to increase the volume of the monitoring signal high enough, which increases the noise level experienced by the players themselves. The same 3D sound environment that is provided to the audience can be provided for the band or orchestra itself e.g. through the use of a cubic loudspeaker arrangement surrounding the band or orchestra. As a further example, a 3D sound environment can be used in live shows also for special effects, e.g. for moving sounds around.

In a further advantageous embodiment of the invention, ground reflections are simulated by simulating a virtual floor, for example by simulating the effects a floor would have on the sound signals heard by a listener.

In the following, certain aspects of the invention are described in more detail.

Figure 4:
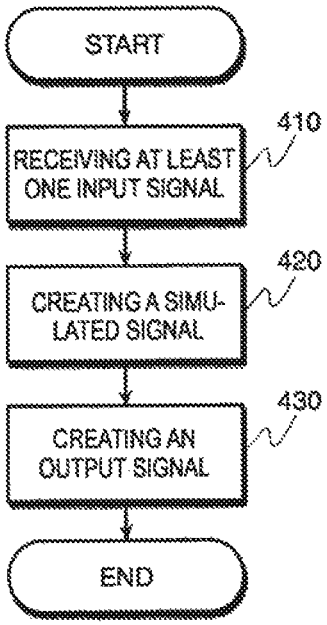
FIG. 4 illustrates a method according to a first aspect of the invention.

According to a first aspect of the invention, a method for processing audio signals for creating a three dimensional sound environment is provided. This aspect is described in the following with reference to FIG. 4. In this first aspect, the method comprises at least the steps of receiving 410 at least one input signal from at least one sound source, creating 420 a simulated signal at least in part on the basis of said received at least one input signal, said simulated signal representing a simulation of at least one input signal reflecting from the ground or a floor, and creating 430 an output signal at least partly on the basis of said simulated signal and said at least one received input signal, said output signal comprising a plurality of audio channels; at least two channels of said audio channels of said output signal representing signals for sound transducers above a listener's ear level at a nominal listening position, and at least two channels of said audio channels of said output signal representing signals for sound transducers below a listener's ear level at a nominal listening position.

In the step of receiving at least one input signal, the signal can be received from a storage means, from a software program, or for example from an analog audio input.

According to a further advantageous embodiment according to this first aspect of the invention, the method further comprises at least the steps of creating output signals for a background sound environment by receiving at least two input signals from at least one sound source, creating simulated signals at least in part on the basis of said received at least two input signals, said simulated signals representing a simulation of said at least two input signals reflecting from the ground or a floor, creating an background output signal at least partly on the basis of said simulated signals and said at least two received input signals; and adding an object on top of the created background by adding sound signals representing the sound of said object to said output signal channels.

According to a further advantageous embodiment according to this first aspect of the invention, said output signal comprises

- at least one channel representing a signal for a sound transducer above and to the right of a listeners ears in the nominal listening position,
- at least one channel representing a signal for a sound transducer above and to the left of a listeners ears in the nominal listening position,
- at least one channel representing a signal for a sound transducer below and to the right of a listeners ears in the nominal listening position, and
- at least one channel representing a signal for a sound transducer below and to the left of a listeners ears in the nominal listening position.

According to a further advantageous embodiment according to this first aspect of the invention, said output signal further comprises an audio channel for low-frequency audio for a subwoofer sound transducer.

According to a further advantageous embodiment according to this first aspect of the invention, said output signal comprises at least

- at least one channel representing a signal for a sound transducer in front of, above and to the right of a listener's ears in the nominal listening position,
- at least one channel representing a signal for a sound transducer in front of, above and to the left of a listener's ears in the nominal listening position,
- at least one channel representing a signal for a sound transducer in front of, below and to the right of a listener's ears in the nominal listening position,
- at least one channel representing a signal for a sound transducer in front of, below and to the left of a listeners ears in the nominal listening position,
- at least one channel representing a signal for a sound transducer behind, above and to the right of a listener's ears in the nominal listening position,
- at least one channel representing a signal for a sound transducer behind, above and to the left of a listener's ears in the nominal listening position,
- at least one channel representing a signal for a sound transducer behind, below and to the right of a listener's ears in the nominal listening position, and
- at least one channel representing a signal for a sound transducer behind, below and to the left of a listeners ears in the nominal listening position.

According to a further advantageous embodiment according to this first aspect of the invention, said output signal further comprises an audio channel for low-frequency audio for a subwoofer sound transducer.

According to a further advantageous embodiment according to this first aspect of the invention, a simulation of said at least one input signal reflecting from the ground or a floor is created by adding at least a part of said at least one input signal to output signal channels representing signals for sound transducers diagonally opposite each other in a vertical plane.

According to a further advantageous embodiment according to this first aspect of the invention, said at least a part of said at least one input signal is added to an output signal channel representing a signal for a transducer above a listener's ear at a nominal listening position with a first amplitude and to an output signal channel representing a signal for a transducer below a listeners ear at a nominal listening position with a second amplitude, said first amplitude being smaller than the second amplitude.

According to a further advantageous embodiment according to this first aspect of the invention, the ratios of the first and second amplitudes are within the range of 49:51 to 30:70.

According to a further advantageous embodiment according to this first aspect of the invention, the ratios of the first and second amplitudes are within the range of 40:60 to 37:63.

According to a further advantageous embodiment according to this first aspect of the invention, the method further comprises at least the steps of enhancing a part of the frequency spectrum of a signal to be added to an output signal channel corresponding to a sound transducer below a listener's ear at a nominal listening position, said part of the frequency spectrum being lower than a predetermined frequency.

According to a further advantageous embodiment according to this first aspect of the invention, the method further comprises at least the steps of obtaining a predetermined multichannel signal from a storage means, and adding the signal of each channel of said multichannel signal to a corresponding output channel.

Figure 5:
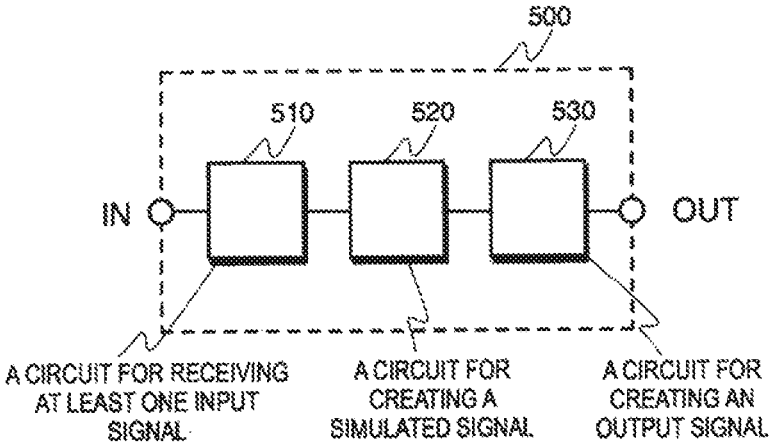
FIG. 5 illustrates a sound processing unit according to a second aspect of the invention.

According to a second aspect of the invention, a sound processing unit for processing audio signals for creating a three dimensional sound environment is provided. The sound processing unit according to this second aspect of the invention is illustrated in FIG. 5. According to this second aspect, the sound processing unit 500 comprises at least a circuit 510 for receiving at least one input signal from at least one sound source, a circuit 520 for creating a simulated signal at least in part on the basis of said received at least one input signal, said simulated signal representing a simulation of at least one input signal reflecting from the ground or a floor, and a circuit 530 for creating an output signal at least partly on the basis of said simulated signal and said at least one received input signal, said output signal comprising a plurality of audio channels;

at least two channels of said audio channels of said output signal representing signals for sound transducers above a listener's ear level at a nominal listening position, and at least two channels of said audio channels of said output signal representing signals for sound transducers below a listeners ear level at a nominal listening position.

The circuit 510 for receiving at least one input signal can be arranged to receive the signal from a storage means, from a software program, or for example from an analog audio input.

The circuit 520 for creating a simulated signal can be for example a sound signal processor such as a DSP (Digital Signal Processor) circuit, or for example an analog mixing circuit. The circuit 530 for creating an output signal can also be for example a sound signal processor such as a DSP (Digital Signal Processor) circuit, or for example an analog mixing circuit. The circuit 510 for receiving at least one input signal, the circuit 530 for creating an output signal and the circuit 520 for creating a simulated signal can be implemented in a single circuit, for example in a single DSP circuit.

According to a further advantageous embodiment of the second aspect of the invention, the sound processing unit further comprises at least a circuit for receiving at least two input signals from at least one sound source, a circuit for creating simulated signals at least in part on the basis of said received at least two input signals, said simulated signals representing a simulation of said at least two input signals reflecting from the ground or a floor, a circuit for creating an background output signal at least partly on the basis of said simulated signals and said at least two received input signals; and a circuit for adding an object on top of the created background by adding sound signals representing the sound of said object to said output signal channels.

According to a further advantageous embodiment of the second aspect of the invention, said output signal comprises

- at least one channel representing a signal for a sound transducer above and to the right of a listeners ears in the nominal listening position,
- at least one channel representing a signal for a sound transducer above and to the left of a listeners ears in the nominal listening position,
- at least one channel representing a signal for a sound transducer below and to the right of a listeners ears in the nominal listening position, and
- at least one channel representing a signal for a sound transducer below and to the left of a listeners ears in the nominal listening position.

According to a further advantageous embodiment of the second aspect of the invention, said output signal further comprises an audio channel for low-frequency audio for a subwoofer sound transducer.

According to a further advantageous embodiment of the second aspect of the invention, said output signal comprises at least

- at least one channel representing a signal for a sound transducer in front of, above and to the right of a listener's ears in the nominal listening position,
- at least one channel representing a signal for a sound transducer in front of, above and to the left of a listener's ears in the nominal listening position,
- at least one channel representing a signal for a sound transducer in front of, below and to the right of a listener's ears in the nominal listening position,
- at least one channel representing a signal for a sound transducer in front of, below and to the left of a listener's ears in the nominal listening position,
- at least one channel representing a signal for a sound transducer behind, above and to the right of a listener's ears in the nominal listening position,
- at least one channel representing a signal for a sound transducer behind, above and to the left of a listener's ears in the nominal listening position,
- at least one channel representing a signal for a sound transducer behind, below and to the right of a listener's ears in the nominal listening position, and
- at least one channel representing a signal for a sound transducer behind, below and to the left of a listener's ears in the nominal listening position.

According to a further advantageous embodiment of the second aspect of the invention, said output signal further comprises an audio channel for low-frequency audio for a subwoofer sound transducer.

According to a further advantageous embodiment of the second aspect of the invention, said circuit for creating a simulated signal at least in part on the basis of said received at least one input signal is arranged to create said simulated signal by adding at least a part of said at least one input signal to output signal channels representing signals for sound transducers diagonally opposite each other in a vertical plane.

According to a further advantageous embodiment of the second aspect of the invention, said circuit for creating a simulated signal is arranged to add said at least a part of said at least one input signal to an output signal channel representing a signal for a transducer above a listeners ear at a nominal listening position with a first amplitude and to an output signal channel representing a signal for a transducer below a listener's ear at a nominal listening position with a second amplitude, said first amplitude being smaller than the second amplitude.

According to a further advantageous embodiment of the second aspect of the invention, the ratios of the first and second amplitudes are within the range of 49:51 to 30:70.

According to a further advantageous embodiment of the second aspect of the invention, the ratios of the first and second amplitudes are within the range of 40:60 to 37:63.

According to a further advantageous embodiment of the second aspect of the invention, the sound processing unit further comprises at least a circuit for enhancing a part of the frequency spectrum of a signal to be added to an output signal channel corresponding to a sound transducer below a listener's ear at a nominal listening position, said part of the frequency spectrum being lower than a predetermined frequency.

According to a further advantageous embodiment of the second aspect of the invention, the sound processing unit further comprises at least a processor for obtaining a predetermined multichannel signal from a storage means, and a circuit for adding the signal of each channel of said multichannel signal to a corresponding output channel.

In a further advantageous embodiment of the invention, the sound processing unit is a part of a game system.

Figure 6:
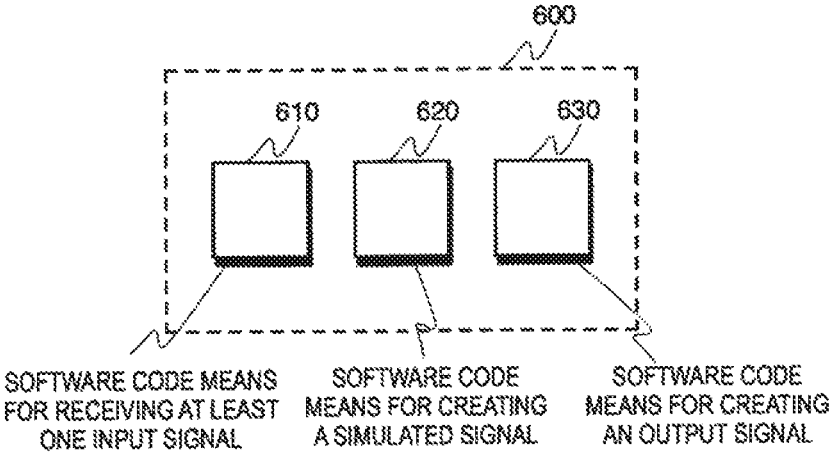
FIG. 6 illustrates a software program product according to a third aspect of the invention.

According to a third aspect of the invention, a software program product for processing audio signals for creating a three dimensional sound environment is provided. This third aspect of the invention is illustrated in FIG. 6. According to this third aspect of the invention, the software program product 600 comprises at least software code means 610 for receiving at least one input signal from at least one sound source, software code means 620 for creating a simulated signal at least in part on the basis of said received at least one input signal, said simulated signal representing a simulation of at least one input signal reflecting from the ground or a floor, and software code means 630 for creating an output signal at least partly on the basis of said simulated signal and said at least one received input signal, said output signal comprising a plurality of audio channels;

at least two channels of said audio channels of said output signal representing signals for sound transducers above a listener's ear level at a nominal listening position, and at least two channels of said audio channels of said output signal representing signals for sound transducers below a listener's ear level at a nominal listening position.

In an advantageous embodiment according to this third aspect of the invention, the software program product further comprises at least software code means for receiving at least two input signals from at least one sound source, software code means for creating simulated signals at least in part on the basis of said received at least two input signals, said simulated signals representing a simulation of said at least two input signals reflecting from the ground or a floor, software code means for creating an background output signal at least partly on the basis of said simulated signals and said at least two received input signals; and software code means for adding an object on top of the created background by adding sound signals representing the sound of said object to said output signal channels.

In a further advantageous embodiment according to this third aspect of the invention, said output signal comprises

- at least one channel representing a signal for a sound transducer above and to the right of a listener's ears in the nominal listening position,
- at least one channel representing a signal for a sound transducer above and to the left of a listener's ears in the nominal listening position,
- at least one channel representing a signal for a sound transducer below and to the right of a listener's ears in the nominal listening position, and
- at least one channel representing a signal for a sound transducer below and to the left of a listener's ears in the nominal listening position.

In a further advantageous embodiment according to this third aspect of the invention, said output signal further comprises an audio channel for low-frequency audio for a subwoofer sound transducer.

In a further advantageous embodiment according to this third aspect of the invention, said output signal comprises at least

- at least one channel representing a signal for a sound transducer in front of, above and to the right of a listener's ears in the nominal listening position,
- at least one channel representing a signal for a sound transducer in front of, above and to the left of a listener's ears in the nominal listening position,
- at least one channel representing a signal for a sound transducer in front of, below and to the right of a listener's ears in the nominal listening position,
- at least one channel representing a signal for a sound transducer in front of, below and to the left of a listener's ears in the nominal listening position,
- at least one channel representing a signal for a sound transducer behind, above and to the right of a listener's ears in the nominal listening position,
- at least one channel representing a signal for a sound transducer behind, above and to the left of a listener's ears in the nominal listening position,
- at least one channel representing a signal for a sound transducer behind, below and to the right of a listener's ears in the nominal listening position, and
- at least one channel representing a signal for a sound transducer behind, below and to the left of a listener's ears in the nominal listening position.

In a further advantageous embodiment according to this third aspect of the invention, said output signal further comprises an audio channel for low-frequency audio for a subwoofer sound transducer.

In a further advantageous embodiment according to this third aspect of the invention, said software code means for creating a simulated signal at least in part on the basis of said received at least one input signal is arranged to create said simulated signal by adding at least a part of said at least one input signal to output signal channels representing signals for sound transducers diagonally opposite each other in a vertical plane.

In a further advantageous embodiment according to this third aspect of the invention, said software code means for creating a simulated signal is arranged to add said at least a part of said at least one input signal to an output signal channel representing a signal for a transducer above a listeners ear at a nominal listening position with a first amplitude and to an output signal channel representing a signal for a transducer below a listeners ear at a nominal listening position with a second amplitude, said first amplitude being smaller than the second amplitude.

In a further advantageous embodiment according to this third aspect of the invention, the ratios of the first and second amplitudes are within the range of 49:51 to 30:70.

In a further advantageous embodiment according to this third aspect of the invention, the ratios of the first and second amplitudes are within the range of 40:60 to 37:63.

In a further advantageous embodiment according to this third aspect of the invention, the software program product further comprises at least software code means for enhancing a part of the frequency spectrum of a signal to be added to an output signal channel corresponding to a sound transducer below a listener's ear at a nominal listening position, said part of the frequency spectrum being lower than a predetermined frequency.

In a further advantageous embodiment according to this third aspect of the invention, the software program product further comprises at least software code means for obtaining a predetermined multichannel signal from a storage means, and software code means for adding the signal of each channel of said multichannel signal to a corresponding output channel.

In a further advantageous embodiment according to this third aspect of the invention, said software program product is at least a part of a game software program product.

According to a further aspect of the invention, said software program product is provided as embodied on a computer readable medium.

In view of the foregoing description it will be evident to a person skilled in the art that various modifications may be made within the scope of the invention. While a preferred embodiment of the invention has been described in detail, it should be apparent that many modifications and variations thereto are possible, all of which fall within the true spirit and scope of the invention.

The invention claimed is:

1. A method for processing audio signals for creating a three dimensional sound environment, comprising:

receiving at least one input signal from at least one sound source, creating a simulated signal at least in part on the basis of said received at least one input signal, said simulated signal representing a simulation of at least one input signal reflecting from the ground or a floor, and creating an output signal at least partly on the basis of said simulated signal and said at least one received input signal, said output signal comprising a plurality of audio channels;

at least two channels of said audio channels of said output signal representing signals for sound transducers above a listener's ear level at a nominal listening position, and at least two channels of said audio channels of said output signal representing signals for sound transducers below a listener's ear level at a nominal listening position, wherein said output signal comprises at least one channel representing a signal for a sound transducer in front of, above and to the right of a listener's ears in the nominal listening position, at least one channel representing a signal for a sound transducer in front of, above and to the left of a listener's ears in the nominal listening position, at least one channel representing a signal for a sound transducer in front of, below and to the right of a listener's ears in the nominal listening position, at least one channel representing a signal for a sound transducer in front of, below and to the left of a listener's ears in the nominal listening position, at least one channel representing a signal for a sound transducer behind, above and to the right of a listener's ears in the nominal listening position, at least one channel representing a signal for a sound transducer behind, above and to the left of a listener's ears in the nominal listening position, at least one channel representing a signal for a sound transducer behind, below and to the right of a listener's ears in the nominal listening position, and at least one channel representing a signal for a sound transducer behind, below and to the left of a listener's ears in the nominal listening position.

2. The method according to claim 1, further comprising at least the steps of creating output signals for a background sound environment by receiving at least two input signals from at least one sound source, creating simulated signals at least in part on the basis of said received at least two input signals, said simulated signals representing a simulation of said at least two input signals reflecting from the ground or a floor, creating a background output signal at least partly on the basis of said simulated signals and said at least two received input signals, and adding an object on top of the created background by adding sound signals representing the sound of said object to said output signal channels.

3. The method according to claim 1, wherein said output signal comprises at least one channel representing a signal for a sound transducer above and to the right of a listener's ears in the nominal listening position, at least one channel representing a signal for a sound transducer above and to the left of a listener's ears in the nominal listening position, at least one channel representing a signal for a sound transducer below and to the right of a listener's ears in the nominal listening position, and at least one channel representing a signal for a sound transducer below and to the left of a listener's ears in the nominal listening position.

4. The method according to claim 3, wherein said output signal further comprises an audio channel for low-frequency audio for a subwoofer sound transducer.

5. The method according to claim 1, wherein said output signal further comprises an audio channel for low-frequency audio for a subwoofer sound transducer.

6. The method according to claim 1, wherein a simulation of said at least one input signal reflecting from the ground or a floor is created by adding at least a part of said at least one input signal to output signal channels representing signals for sound transducers diagonally opposite each other in a vertical plane.

7. The method according to claim 6, wherein said at least a part of said at least one input signal is added to an output signal channel representing a signal for a transducer above a listener's ear at a nominal listening position with a first amplitude and to an output signal channel representing a signal for a transducer below a listener's ear at a nominal listening position with a second amplitude, said first amplitude being smaller than the second amplitude.

8. The method according to claim 7, wherein the ratios of the first and second amplitudes are within the range of 49:51 to 30:70.

9. The method according to claim 7, wherein the ratios of the first and second amplitudes are within the range of 40:60 to 37:63.

10. The method according to claim 6, further comprising:

enhancing a part of the frequency spectrum of a signal to be added to an output signal channel corresponding to a sound transducer below a listener's ear at a nominal listening position, said part of the frequency spectrum being lower than a predetermined frequency.

11. The method according to claim 1, further comprising:

obtaining a predetermined multichannel signal from a storage means, and adding the signal of each channel of said multichannel signal to a corresponding output channel.

12. A sound processing unit for processing audio signals for creating a three dimensional sound environment, comprising:

a first circuit for receiving at least one input signal from at least one sound source, a second circuit for creating a simulated signal at least in part on the basis of said received at least one input signal, said simulated signal representing a simulation of at least one input signal reflecting from the ground or a floor, and a third circuit for creating an output signal at least partly on the basis of said simulated signal and said at least one received input signal, said output signal comprising a plurality of audio channels;

at least two channels of said audio channels of said output signal representing signals for sound transducers above a listener's ear level at a nominal listening position, and at least two channels of said audio channels of said output signal representing signals for sound transducers below a listener's ear level at a nominal listening position, wherein said output signal comprises at least one channel representing a signal for a sound transducer in front of, above and to the right of a listener's ears in the nominal listening position, at least one channel representing a signal for a sound transducer in front of, above and to the left of a listener's ears in the nominal listening position, at least one channel representing a signal for a sound transducer in front of, below and to the right of a listener's ears in the nominal listening position, at least one channel representing a signal for a sound transducer in front of, below and to the left of a listener's ears in the nominal listening position, at least one channel representing a signal for a sound transducer behind, above and to the right of a listener's ears in the nominal listening position, at least one channel representing a signal for a sound transducer behind, above and to the left of a listener's ears in the nominal listening position, at least one channel representing a signal for a sound transducer behind, below and to the right of a listener's ears in the nominal listening position, and at least one channel representing a signal for a sound transducer behind, below and to the left of a listener's ears in the nominal listening position.

13. The sound processing unit according to claim 12, further comprising:

a fourth circuit for receiving at least two input signals from at least one sound source, a fifth circuit for creating simulated signals at least in part on the basis of said received at least two input signals, said simulated signals representing a simulation of said at least two input signals reflecting from the ground or a floor, a sixth circuit for creating a background output signal at least partly on the basis of said simulated signals and said at least two received input signals, and a seventh circuit for adding an object on top of the created background by adding sound signals representing the sound of said object to said output signal channels.

14. The sound processing unit according to claim 12, wherein said output signal comprises at least one channel representing a signal for a sound transducer above and to the right of a listener's ears in the nominal listening position, at least one channel representing a signal for a sound transducer above and to the left of a listener's ears in the nominal listening position, at least one channel representing a signal for a sound transducer below and to the right of a listener's ears in the nominal listening position, and at least one channel representing a signal for a sound transducer below and to the left of a listener's ears in the nominal listening position.

15. The sound processing unit according to claim 14, wherein said output signal further comprises an audio channel for low-frequency audio for a subwoofer sound transducer.

16. The sound processing unit according to claim 12, wherein said output signal further comprises an audio channel for low-frequency audio for a subwoofer sound transducer.

17. The sound processing unit according to claim 12, wherein said circuit for creating a simulated signal at least in part on the basis of said received at least one input signal is arranged to create said simulated signal by adding at least a part of said at least one input signal to output signal channels representing signals for sound transducers diagonally opposite each other in a vertical plane.

18. The sound processing unit according to claim 17, wherein said circuit for creating a simulated signal is arranged to add said at least a part of said at least one input signal to an output signal channel representing a signal for a transducer above a listener's ear at a nominal listening position with a first amplitude and to an output signal channel representing a signal for a transducer below a listener's ear at a nominal listening position with a second amplitude, said first amplitude being smaller than the second amplitude.

19. The sound processing unit according to claim 18, wherein the ratios of the first and second amplitudes are within the range of 49:51 to 30:70.

20. The sound processing unit according to claim 18, wherein the ratios of the first and second amplitudes are within the range of 40:60 to 37:63.

21. The sound processing unit according to claim 12, further comprising a processor for obtaining a predetermined multichannel signal from a storage means.

22. A software program product embodied on a non-transitory storage medium for processing audio signals for creating a three dimensional sound environment, comprising:

software code means for receiving at least one input signal from at least one sound source, software code means for creating a simulated signal at least in part on the basis of said received at least one input signal, said simulated signal representing a simulation of at least one input signal reflecting from the ground or a floor, and software code means for creating an output signal at least partly on the basis of said simulated signal and said at least one received input signal, said output signal comprising a plurality of audio channels;

at least two channels of said audio channels of said output signal representing signals for sound transducers above a listener's ear level at a nominal listening position, and at least two channels of said audio channels of said output signal representing signals for sound transducers below a listener's ear level at a nominal listening position, wherein said output signal comprises at least one channel representing a signal for a sound transducer in front of, above and to the right of a listener's ears in the nominal listening position, at least one channel representing a signal for a sound transducer in front of, above and to the left of a listener's ears in the nominal listening position, at least one channel representing a signal for a sound transducer in front of, below and to the right of a listener's ears in the nominal listening position, at least one channel representing a signal for a sound transducer in front of, below and to the left of a listener's ears in the nominal listening position, at least one channel representing a signal for a sound transducer behind, above and to the right of a listener's ears in the nominal listening position, at least one channel representing a signal for a sound transducer behind, above and to the left of a listener's ears in the nominal listening position, at least one channel representing a signal for a sound transducer behind, below and to the right of a listener's ears in the nominal listening position, and at least one channel representing a signal for a sound transducer behind, below and to the left of a listener's ears in the nominal listening position.

23. The software program product according to claim 22, further comprising software code for receiving at least two input signals from at least one sound source, software code for creating simulated signals at least in part on the basis of said received at least two input signals, said simulated signals representing a simulation of said at least two input signals reflecting from the ground or a floor, software code for creating a background output signal at least partly on the basis of said simulated signals and said at least two received input signals, and software code for adding an object on top of the created background by adding sound signals representing the sound of said object to said output signal channels.

24. The software program product according to claim 22, wherein said output signal comprises at least one channel representing a signal for a sound transducer above and to the right of a listener's ears in the nominal listening position, at least one channel representing a signal for a sound transducer above and to the left of a listener's ears in the nominal listening position, at least one channel representing a signal for a sound transducer below and to the right of a listener's ears in the nominal listening position, and at least one channel representing a signal for a sound transducer below and to the left of a listener's ears in the nominal listening position.

25. The software program product according to claim 24, wherein said output signal further comprises an audio channel for low-frequency audio for a subwoofer sound transducer.

26. The software program product according to claim 22, wherein said output signal further comprises an audio channel for low-frequency audio for a subwoofer sound transducer.

27. The software program product according to claim 22, wherein said software code means for creating a simulated signal at least in part on the basis of said received at least one input signal is arranged to create said simulated signal by adding at least a part of said at least one input signal to output signal channels representing signals for sound transducers diagonally opposite each other in a vertical plane.

28. The software program product according to claim 27, wherein said software code means for creating a simulated signal is arranged to add said at least a part of said at least one input signal to an output signal channel representing a signal for a transducer above a listener's ear at a nominal listening position with a first amplitude and to an output signal channel representing a signal for a transducer below a listener's ear at a nominal listening position with a second amplitude, said first amplitude being smaller than the second amplitude.

29. The software program product according to claim 28, wherein the ratios of the first and second amplitudes are within the range of 49:51 to 30:70.

30. The software program product according to claim 28, wherein the ratios of the first and second amplitudes are within the range of 40:60 to 37:63.

31. The software program product according to claim 27, further comprising software code means for enhancing a part of the frequency spectrum of a signal to be added to an output signal channel corresponding to a sound transducer below a listener's ear at a nominal listening position, said part of the frequency spectrum being lower than a predetermined frequency.

32. The software program product according to claim 22, further comprising software code means for obtaining a predetermined multichannel signal from a storage means, and software code means for adding the signal of each channel of said multichannel signal to a corresponding output channel.

33. The software program product according to claim 22, wherein said software program product is at least a part of a game software program product.

* * * * *